US010932972B1

(12) United States Patent
Bennett et al.

(10) Patent No.: US 10,932,972 B1
(45) Date of Patent: Mar. 2, 2021

(54) TOILET AID APPARATUS

(71) Applicants: Peter Bennett, Durham (CA); Isabel Bennett, Durham (CA)

(72) Inventors: Peter Bennett, Durham (CA); Isabel Bennett, Durham (CA)

( * ) Notice: Subject to any disclaimer, the term of this patent is extended or adjusted under 35 U.S.C. 154(b) by 0 days.

(21) Appl. No.: 16/401,238

(22) Filed: May 2, 2019

(51) Int. Cl.
*A61G 7/10* (2006.01)
*A47K 13/10* (2006.01)

(52) U.S. Cl.
CPC ..... *A61G 7/1007* (2013.01); *A47K 13/10* (2013.01)

(58) Field of Classification Search
CPC ..... A61G 7/1007; A47K 13/10
See application file for complete search history.

(56) References Cited

U.S. PATENT DOCUMENTS 3,473,174 A * 10/1969 Cool ..... A61G 7/1007 4/667
3,619,820 A 11/1971 Medlock
4,031,576 A 6/1977 Epstein
4,343,052 A * 8/1982 Guenther ..... A47K 17/026 297/411.23
4,884,841 A * 12/1989 Holley ..... A61G 5/14 297/331
5,142,709 A * 9/1992 McGuire ..... A61G 7/1007 4/667
6,507,961 B1 * 1/2003 Ming-Hwa ..... A61G 5/14 297/DIG. 10
8,056,158 B2 * 11/2011 Henshaw ..... A61G 7/1007 297/DIG. 10
9,066,841 B2 * 6/2015 Mastropole ..... A61G 7/1007

* cited by examiner

*Primary Examiner* — Erin Deery
(74) *Attorney, Agent, or Firm* — Sanchelima & Associates, P.A.; Christian Sanchelima; Alexander J. Rodriguez

(57) ABSTRACT

A toilet aid apparatus is disclosed herein. The apparatus comprises a support structure, a platform mounted to the support structure, and a displacement unit coupled to the platform to facilitate lifting and lowering of the platform, thereby aiding a person in sitting on a toilet bowl and in standing up subsequent to the use of the toilet bowl. The platform is configured to be rested on a toilet bowl. The displacement means, which can be a hydraulic or a pneumatic cylinder, can be operable via a handheld remote controller.

1 Claim, 6 Drawing Sheets

TOILET AID APPARATUS

BACKGROUND OF THE INVENTION

1. Field of the Invention

The present disclosure relates to the field of aid apparatuses for invalid individuals. In particular, the present disclosure relates to an aid apparatus for assisting an invalid person to comfortably use a toilet.

2. Description of the Related Art

Invalid individuals are individuals who are rendered weak due to illnesses. Many such individuals find it difficult to perform some of the most basic everyday tasks, e.g., relieving oneself on the toilet. An invalid individual may find it difficult to sit on the commode and get up thereafter without any support. Therefore, there is felt a need to provide an apparatus that can ease the entire process of visiting the toilet easy for invalid individuals as well as for the elderlies.

Several designs for aid systems have been designed in the past. None of them, however, are known to have a simple configuration and an automatic operation that provides the user with a very comfortable and pleasant experience to the user, while also providing the user with the feeling of being strong and independent.

Applicant believes that a related reference corresponds to U.S. Pat. No. 3,619,820 filed by THOMAS CAIN AND ODAS MEDLOCK. The Meldock reference discloses a toilet seat comprising a u-shaped member supported at a level below a toilet seat by collars vertically adjustable on supporting legs. The supporting legs penetrate the U-shaped member and have telescopic engagement with downwardly extending portions of a pair of arm rests. However, the toilet seat disclosed in the Meldock reference fails to disclose any means for displacing the toilet means for assisting individuals with limited mobility to sit on and get up from the toilet seat.

Applicant believes that another related reference corresponds to U.S. Pat. No. 4,031,576 filed by HELEN CHARLOTTE EPSTEIN. The Epstein reference discloses an aid for invalids facilitating their ability to be seated and unseated from a water closet utilizing a pair of horizontally disposed arm rests and a hinged commode seat whose elevation and angular position above the water closet is under the manual control of the invalid. However, the aid disclosed in the Epstein reference has a complicated configuration and involves a lot of components. Furthermore, the aid disclosed in the Epstein reference relies on lifting the individuals by providing support to their arms. Such an operation may not be comfortable for some users.

Other documents describing the closest subject matter provide for a number of more or less complicated features that fail to solve the problem in an efficient and economical way. None of these patents suggest the novel features of the present invention.

SUMMARY OF THE INVENTION

It is an object of the present invention to provide a toilet aid apparatus having a simple configuration and an automatic operation.

It is yet another object of the present invention to provide a toilet aid apparatus that provides the user with a very comfortable and pleasant experience to the user, while also providing the user with the feeling of being strong and independent.

Further objects of the invention will be brought out in the following part of the specification, wherein detailed description is for the purpose of fully disclosing the invention without placing any limitations thereon.

BRIEF DESCRIPTION OF THE DRAWING

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
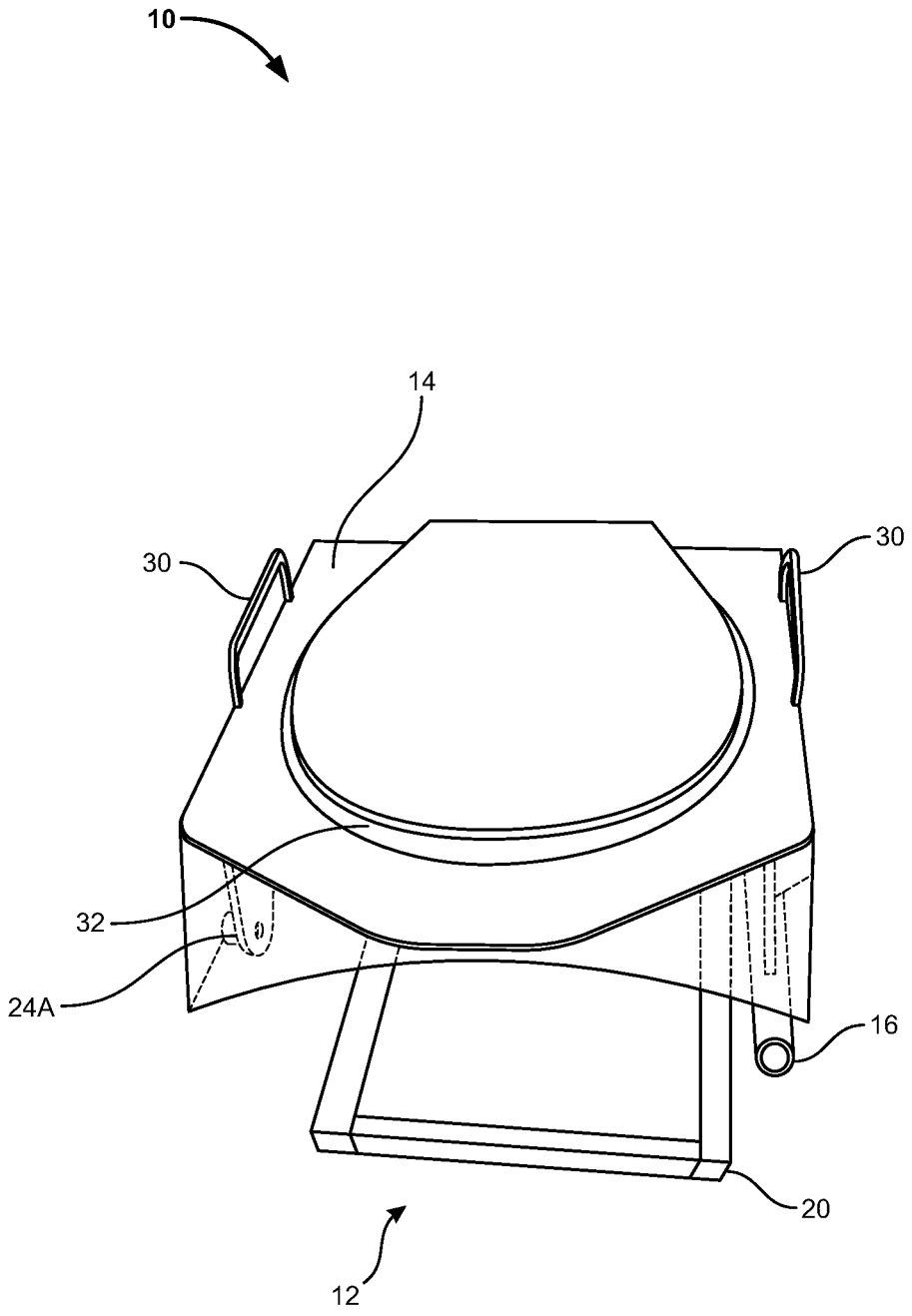
FIG. 1 illustrates an isometric view of a toilet aid apparatus 10, in accordance with an embodiment of the present invention, wherein toilet aid apparatus 10 comprises a support structure 12, a platform 14 mounted to support structure 12, a displacement unit 16 coupled to platform 14 to facilitate lifting and lowering of platform 14.

Referring now to FIGS. 1 through 6, where the present invention is generally referred to with numeral 10, it can be observed that a toilet aid apparatus 10 (interchangeably referred to as apparatus 10), in accordance with an embodiment of the present invention, comprises a support structure 12, a platform 14 mounted to support structure 12, a displacement unit 16 coupled to platform 14 to facilitate lifting and lowering of platform 14, thereby aiding an invalid person in a process of sitting on a toilet bowl 18 and standing up subsequent to the use of toilet bowl 18.

The apparatus 10 comprises support structure 12. Support structure 12 comprises a base 20 and a pair of support pillars 22 extending from base 20. Base 20 has a substantially U-shaped configuration which allows apparatus 10 to be slid on to an existing toilet bowl 18 or commode. Pair of pillars 22 extend in a substantially upright manner from base 20. Base 20 and pair of pillars 22 can be made of any corrosion resistant material, e.g., stainless steel.

Support structure 12 further comprises a platform support 24 mounted atop pair of support pillars 22, wherein platform support is configured to be rested on toilet bowl 18. More specifically, platform support 24 forms a functioning base for platform 14. Platform support 24 is coupled to support pillars 22 via a pair of linkages 26 provided on each side of platform support 24.

Pair of linkages 26 facilitate connection of platform support 24 to each of pair of support pillars 22. More specifically, pair of linkages 26 are pivotally connected to platform support 24 at one end of linkages 26 and each of the pair of support pillars 22 at an opposite operative end of pair of linkages 26. Platform support 24 includes a bracket 24A. Displacement unit 16 is connected to platform support 24 at bracket 24A.

Apparatus 10 further comprises displacement unit 16 coupled to platform 14 to facilitate lifting and lowering of platform 14, thereby aiding an invalid person in a process of sitting on toilet bowl 18 and standing up subsequent to the use of the toilet bowl 18. Displacement unit 16 is provided adjacent base 20. In an embodiment, displacement unit 16 is selected from a group consisting of a hydraulic cylinder and a pneumatic cylinder.

Figure 2:
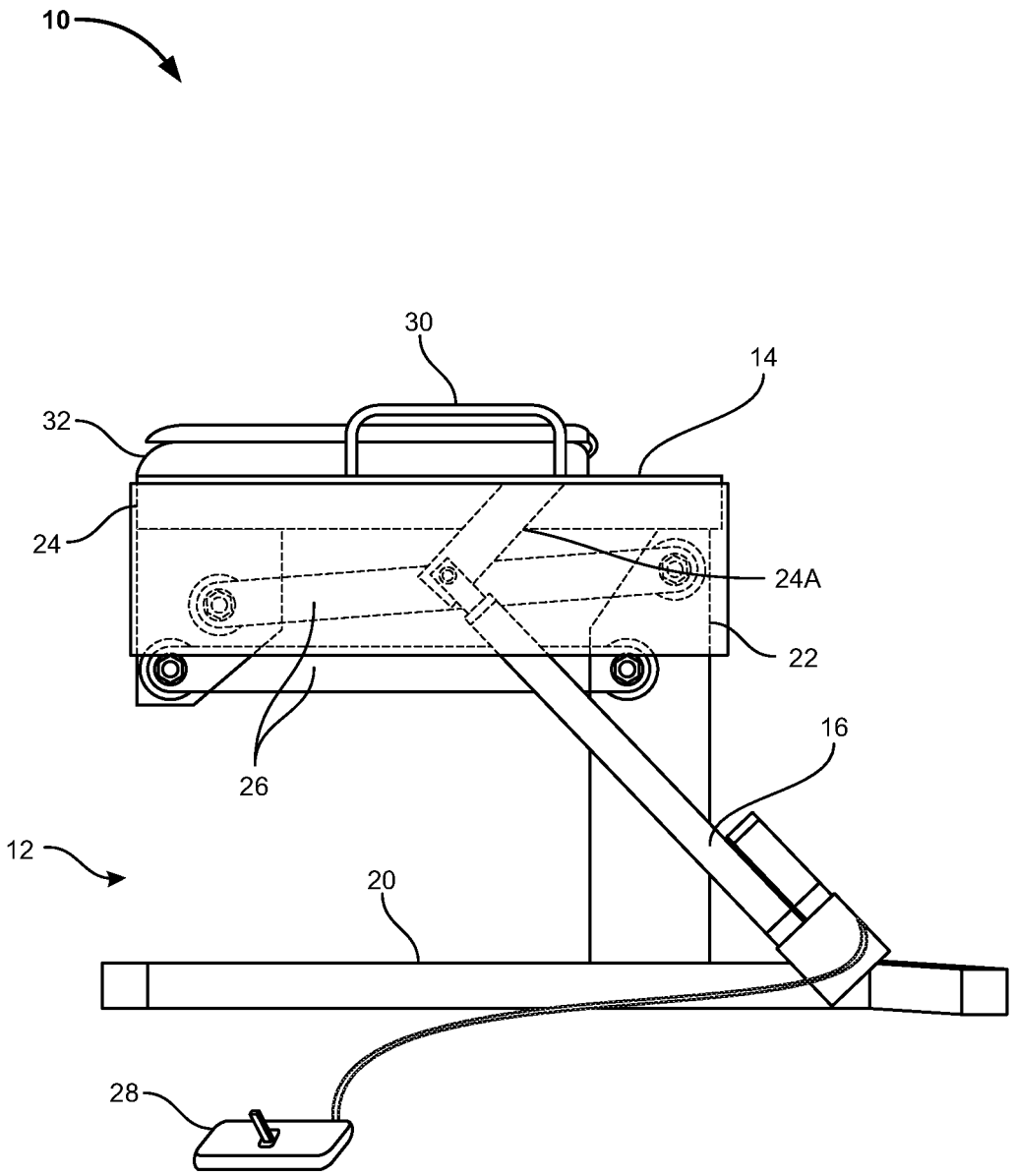
FIG. 2 illustrates a side view of apparatus 10, in accordance with an embodiment of the present invention, depicting a base 20 and a pair of pillars 22 extending from base 20.
Figure 3:
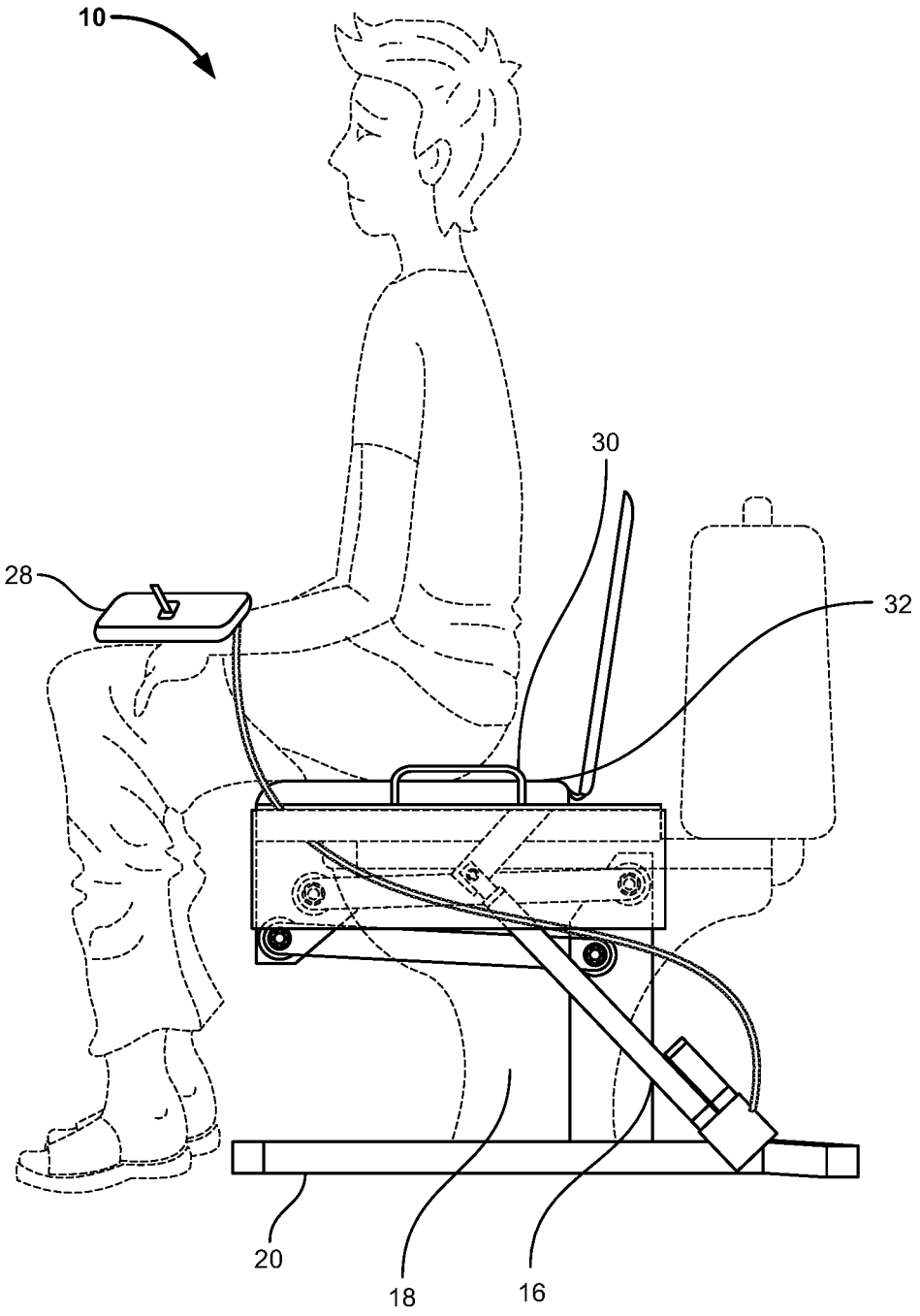
FIG. 3 illustrates another side view of apparatus 10, in accordance with an embodiment of the present invention, depicting a person using apparatus 10 in a lowered configuration of platform 14 and toilet seat 32.
Figure 4:
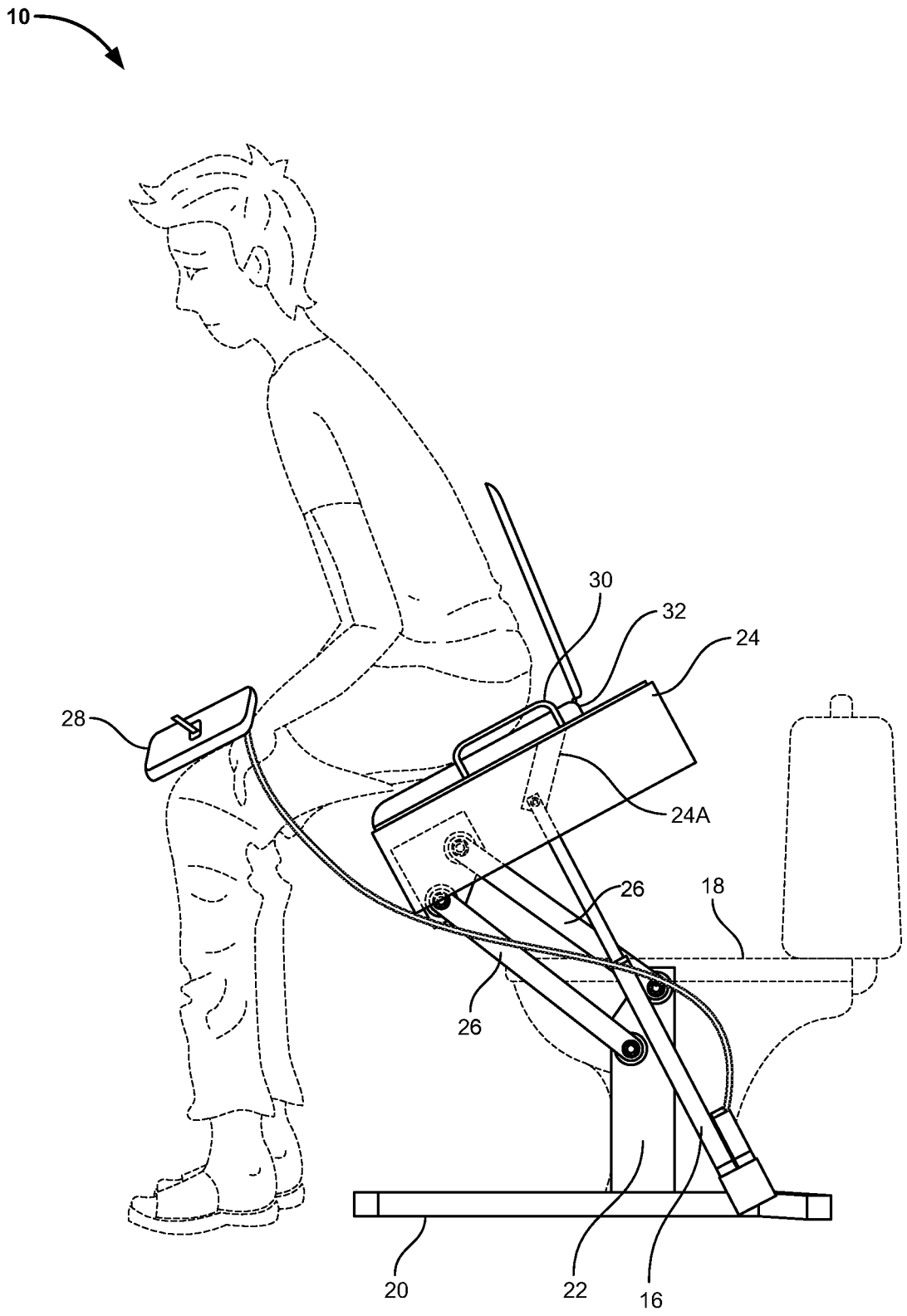
FIG. 4 illustrates another side view of apparatus 10, in accordance with an embodiment of the present invention, depicting a person using apparatus 10 in a raised configuration of platform 14 and toilet seat 32.

In an embodiment, displacement unit 16 is configured for remote operation. More specifically, apparatus 10 further comprises a handheld remote controller 28 for actuating displacement unit 16, thereby causing lifting and lowering of platform 14. In one embodiment, as seen in FIG. 2 through 4, remote controller 28 is a wired remote controller. In another embodiment, remote controller 28 can be a wireless remote controller.

Apparatus 10 further comprises a pair of side braces 30 mounted atop platform 14. The pair of side braces 30 can be of a predetermined shape, size or height in order to accommodate the needs of a user. The pair of side braces 30 can be mount to platform 14 at a predetermined angle as to allow the user to comfortably be able to sit on toilet seat 32. In addition to also providing adequate help to the user when seating or lifting off of toilet seat 32. The pair of side braces 30 can be vertically or horizontally adjusted.

Toilet seat 32 allows the user to be seated on apparatus 10 while using toilet bowl 18. In case of retro-fitment of apparatus 10 on an existing toilet bowl, toilet seat of existing toilet bowl is disassembled and apparatus 10 slid onto existing toilet bowl. U-shaped configuration of base 20 of apparatus 10 allows apparatus 10 to be slid onto toilet bowl 18.

Once apparatus 10 is in place, a user can actuate displacement unit 16 via remote controller 28, thereby causing platform 14 and toilet seat 32 to be raised, as seen in FIG. 4. Once platform 14 and toilet seat 32 are raised, the user can place user's rear on the raised toilet seat 32, and further use remote controller 28 for lowering platform 14 and toilet seat 32, as seen in FIG. 3. Subsequent to the use of toilet bowl 18, the user can use remote controller 28 again to raise platform 14 and toilet seat 32, as seen in FIG. 4. Such lifting and lowering of platform 14 and toilet seat 32 reduces the load acting on the knee joints of the user, thereby substantially reducing the effort required in the entire process of using the toilet.

Figure 5:
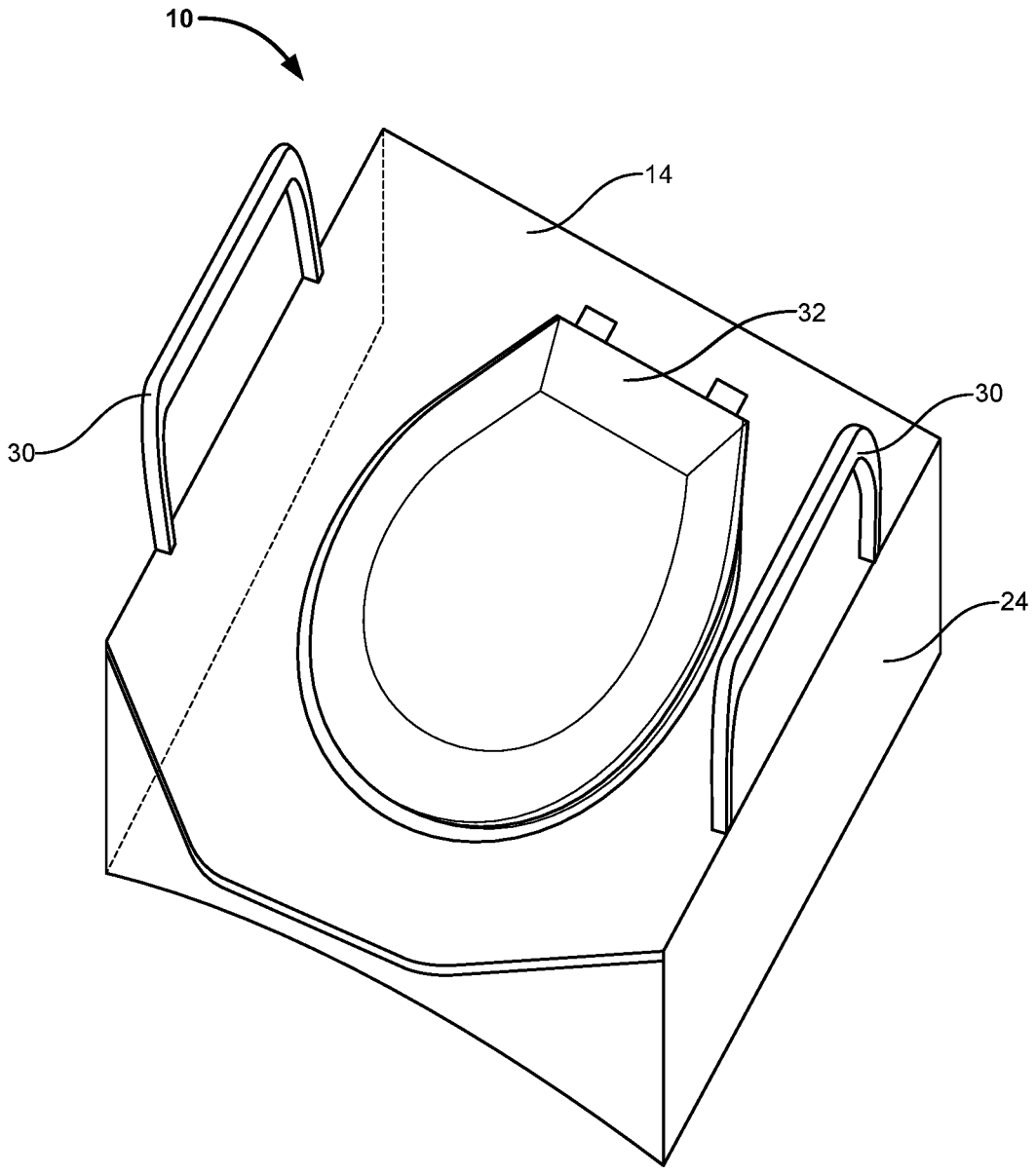
FIG. 5 illustrates a top view of apparatus 10 and platform 14.
Figure 6:
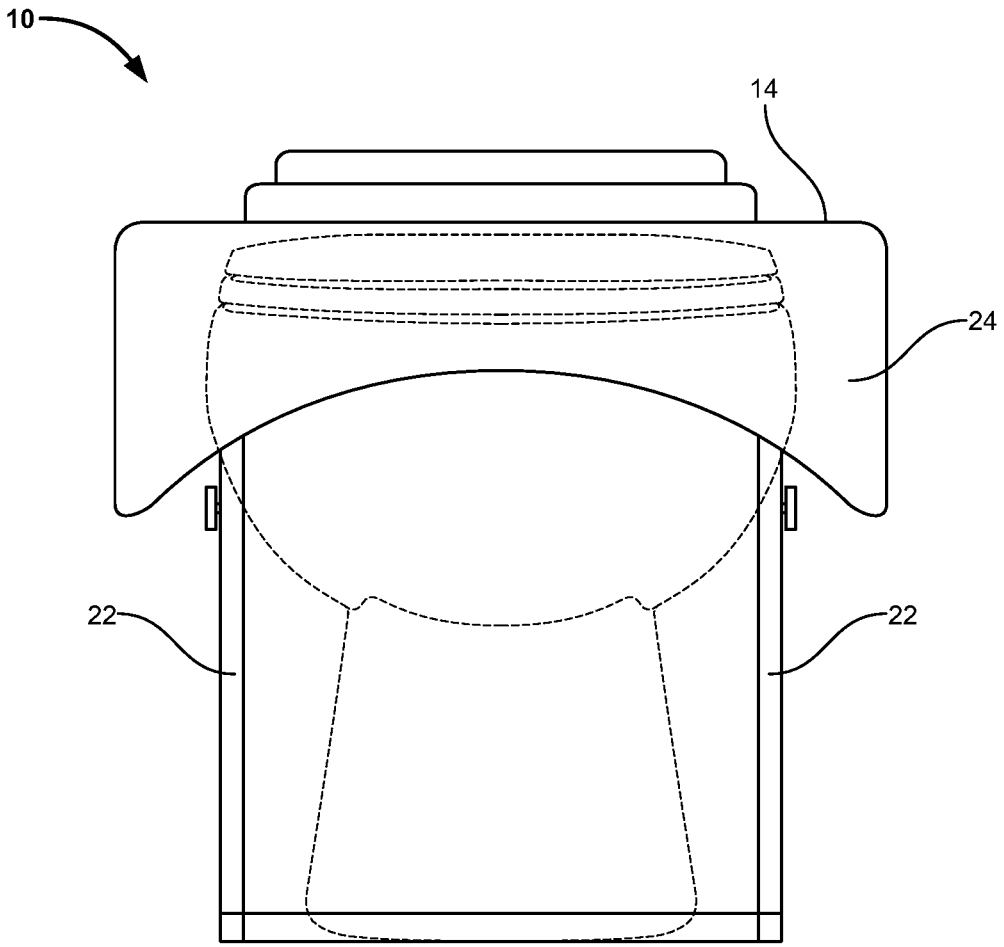
FIG. 6 illustrates a front view of apparatus 10 mounted to a toilet and toilet seat 32.

Referring to FIG. 5 and FIG. 6 it can be seen what platform 14 and platform support 24 may look like from various views, more specifically from a top view and from a front view. In the alternate embodiment seen in FIG. 5 it can be seen that the top side of platform 14 and platform support 24 may be concave. While in the alternate embodiment seen in FIG. 6, it can be seen that the bottom side of platform support 24 may be concave. Alternatively, as seen in FIG. 6 the present invention may be made without pair of side braces 30. Pair of pillars 22 may preferably support the present invention in place over a toilet and toilet seat 32. It can be seen, in FIG. 5 and FIG. 6, that platform support 24 may extend below platform 14, more specifically platform support 24 may extend below and to the sides as well as below and in front of platform 14.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a toilet aid apparatus, consisting of:

a) a toilet;

b) a support structure having a base and a pair of support pillars vertically extending from said base, wherein said base has a U-shaped configuration, wherein said base is slid on a ground surface onto said toilet, wherein said base and said pair of support pillars are made of a stainless steel material, said support structure further including a platform support mounted to a top end of said pair of support pillars, wherein said platform support is rested on a toilet bowl of said toilet, wherein said platform support is a base extending an entire length of said platform, said platform support extending downwardly from said platform and having an inner portion, said platform support further including a bracket located on said inner portion;

c) a pair of linkages mounted to each support pillar, wherein each pair of linkages extends from a respective support pillar and attaches to said inner portion of said platform;

d) a displacement unit coupled to said platform, wherein said displacement unit extends from said base and engages with said bracket on said inner portion of said platform support, wherein said displacement unit is mounted adjacently to said base, wherein said displacement unit is a hydraulic cylinder;

e) a controller having a rectangular shape, wherein said controller is a wired controller for actuating said displacement unit; and f) a pair of side braces mounted to a top end of said platform, wherein said pair of side braces are mounted to opposite edges of said top end, each of said side braces having a U-shaped configuration.

* * * * *